US007287341B2

(12) United States Patent
Ellis, III

(10) Patent No.: US 7,287,341 B2
(45) Date of Patent: Oct. 30, 2007

(54) CORRECTIVE SHOE SOLE STRUCTURES USING A CONTOUR GREATER THAN THE THEORETICALLY IDEAL STABILITY PLANE

(75) Inventor: Frampton E. Ellis, III, Arlington, VA (US)

(73) Assignee: Anatomic Research, Inc., Jasper, FL (US)

( * ) Notice: Subject to any disclaimer, the term of this patent is extended or adjusted under 35 U.S.C. 154(b) by 0 days.

(21) Appl. No.: 10/921,552

(22) Filed: Aug. 19, 2004

(65) Prior Publication Data

US 2005/0016020 A1 Jan. 27, 2005

Related U.S. Application Data

(63) Continuation of application No. 09/993,665, filed on Nov. 27, 2001, now abandoned, which is a continuation of application No. 08/452,490, filed on May 30, 1995, now Pat. No. 6,360,453, which is a continuation of application No. 08/142,120, filed on Oct. 28, 1993, now abandoned, which is a continuation of application No. 07/830,747, filed on Feb. 7, 1992, now abandoned, which is a continuation of application No. 07/416,478, filed on Oct. 3, 1989, now abandoned.

(51) Int. Cl.
*A43B 13/28* (2006.01)

(52) U.S. Cl. ..... 36/25 R; 36/88; 36/30 R

(58) Field of Classification Search ..... 36/32 R, 36/25 R, 30 R, 31, 114, 88, 91, 28, 163, 116, 36/11.5, 11

See application file for complete search history.

(56) References Cited

U.S. PATENT DOCUMENTS

| | | | |
|---|---|---|---|
| 193,914 | A | 8/1877 | Berry |
| 280,791 | A | 7/1883 | Brooks |
| 288,127 | A | 11/1883 | Shepard |
| 500,385 | A | 6/1893 | Hall |
| 532,429 | A | 1/1895 | Rogers |
| 584,373 | A | 6/1897 | Kuhn |
| 1,283,335 | A | 10/1918 | Shillcock |
| 1,289,106 | A | 12/1918 | Bullock |
| D55,115 | S | 1/1920 | Barney |
| 1,458,446 | A | 6/1923 | Shaefer |

(Continued)

FOREIGN PATENT DOCUMENTS

| | | |
|---|---|---|
| AT | 200963 | 5/1958 |

(Continued)

OTHER PUBLICATIONS

Johnson et al., << A Biomechanicl Approach to the Design of Football Boots >>, *Journal of Biomechanics*, vol. 9, pp. 581-585 (1976).

(Continued)

*Primary Examiner*—Marie Patterson
(74) *Attorney, Agent, or Firm*—Knoble Yoshida & Dunleavy, LLC

(57) ABSTRACT

A shoe having a sole contour which follows a theoretically ideal stability plane as a basic concept, but which deviates outwardly therefrom to provide greater than natural stability. Thickness variations outwardly from the stability plane are disclosed, along with density variations to achieve a similar greater than natural stability.

29 Claims, 8 Drawing Sheets

U.S. PATENT DOCUMENTS

| | | | |
|---|---|---|---|
| 1,622,860 | A | 3/1927 | Cutler |
| 1,639,381 | A | 8/1927 | Manelas |
| 1,701,260 | A | 2/1929 | Fischer |
| 1,735,986 | A | 11/1929 | Wray |
| 1,853,034 | A | 4/1932 | Bradley |
| 1,870,751 | A | 8/1932 | Reach |
| 2,120,987 | A | 6/1938 | Murray |
| 2,124,986 | A | 7/1938 | Pipes |
| 2,147,197 | A | 2/1939 | Glidden |
| 2,155,166 | A | 4/1939 | Kraft |
| 2,162,912 | A | 6/1939 | Craver |
| 2,170,652 | A | 8/1939 | Brennan |
| 2,179,942 | A | 11/1939 | Lyne |
| D119,894 | S | 4/1940 | Sherman |
| 2,201,300 | A | 5/1940 | Prue |
| 2,206,860 | A | 7/1940 | Sperry |
| D122,131 | S | 8/1940 | Sannar |
| D128,817 | S | 8/1941 | Esterson |
| 2,251,468 | A | 8/1941 | Smith |
| 2,328,242 | A | 8/1943 | Witherill |
| 2,345,831 | A | 4/1944 | Pierson |
| 2,433,329 | A | 12/1947 | Adler et al. |
| 2,434,770 | A | 1/1948 | Lutey |
| 2,470,200 | A | 5/1949 | Wallach |
| 2,627,676 | A | 2/1953 | Hack |
| 2,718,715 | A | 9/1955 | Spilman |
| 2,814,133 | A | 11/1957 | Herbst |
| 3,005,272 | A | 10/1961 | Shelare et al. |
| 3,100,354 | A | 8/1963 | Lombard et al. |
| 3,110,971 | A | 11/1963 | Chang |
| 3,305,947 | A | 2/1967 | Kalsoy |
| 3,308,560 | A | 3/1967 | Jones |
| 3,416,174 | A | 12/1968 | Novitske |
| 3,512,274 | A | 5/1970 | McGrath |
| 3,535,799 | A | 10/1970 | Onitsuka |
| 3,806,974 | A | 4/1974 | Di Paolo |
| 3,824,716 | A | 7/1974 | Di Paolo |
| 3,863,366 | A | 2/1975 | Auberry et al. |
| 3,958,291 | A | 5/1976 | Spier |
| 3,964,181 | A | 6/1976 | Holcombe, Jr. |
| 3,997,984 | A | 12/1976 | Hayward |
| 4,003,145 | A | 1/1977 | Liebscher et al. |
| 4,030,213 | A | 6/1977 | Daswick |
| 4,043,058 | A | 8/1977 | Hollister et al. |
| 4,068,395 | A | 1/1978 | Senter |
| 4,083,125 | A | 4/1978 | Benseler et al. |
| 4,096,649 | A | 6/1978 | Saurwein |
| 4,098,011 | A | 7/1978 | Bowerman et al. |
| 4,128,950 | A | 12/1978 | Bowerman et al. |
| 4,128,951 | A | 12/1978 | Tansill |
| 4,141,158 | A | 2/1979 | Benseler et al. |
| 4,145,785 | A | 3/1979 | Lacey |
| 4,149,324 | A | 4/1979 | Lesser et al. |
| 4,161,828 | A | 7/1979 | Benseler et al. |
| 4,161,829 | A | 7/1979 | Wayser |
| 4,170,078 | A | 10/1979 | Moss |
| 4,183,156 | A | 1/1980 | Rudy |
| 4,194,310 | A | 3/1980 | Bowerman |
| D256,180 | S | 8/1980 | Turner |
| D256,400 | S | 8/1980 | Famolare, Jr. |
| 4,217,705 | A | 8/1980 | Donzis |
| 4,219,945 | A | 9/1980 | Rudy |
| 4,223,457 | A | 9/1980 | Borgeas |
| 4,227,320 | A | 10/1980 | Borgeas |
| 4,235,026 | A | 11/1980 | Plagenhoef |
| 4,237,627 | A | 12/1980 | Turner |
| 4,240,214 | A | 12/1980 | Sigle et al. |
| 4,241,523 | A | 12/1980 | Daswick |
| 4,245,406 | A | 1/1981 | Landay et al. |
| 4,250,638 | A | 2/1981 | Linnemann |
| 4,258,480 | A | 3/1981 | Famolare, Jr. |
| 4,259,792 | A | 4/1981 | Halberstadt |
| 4,262,433 | A | 4/1981 | Hagg et al. |
| 4,263,728 | A | 4/1981 | Frecentese |
| 4,266,349 | A | 5/1981 | Schmohl |
| 4,268,980 | A | 5/1981 | Gudas |
| 4,271,606 | A | 6/1981 | Rudy |
| 4,272,858 | A | 6/1981 | Hlustik |
| 4,274,211 | A | 6/1981 | Funck |
| 4,297,797 | A | 11/1981 | Meyers |
| 4,302,892 | A | 12/1981 | Adamik |
| 4,305,212 | A | 12/1981 | Coomer |
| 4,308,671 | A | 1/1982 | Bretschneider |
| 4,309,832 | A | 1/1982 | Hunt |
| 4,314,413 | A | 2/1982 | Dassier |
| 4,316,332 | A | 2/1982 | Giese et al. |
| 4,316,335 | A | 2/1982 | Giese et al. |
| 4,319,412 | A | 3/1982 | Muller et al. |
| D264,017 | S | 4/1982 | Turner |
| 4,322,895 | A | 4/1982 | Hockerson |
| D265,019 | S | 6/1982 | Vermonet |
| 4,335,529 | A | 6/1982 | Badalamenti |
| 4,340,626 | A | 7/1982 | Rudy |
| 4,342,161 | A | 8/1982 | Schmohl |
| 4,348,821 | A | 9/1982 | Daswick |
| 4,354,319 | A | 10/1982 | Block et al. |
| 4,361,971 | A | 12/1982 | Bowerman |
| 4,366,634 | A | 1/1983 | Giese et al. |
| 4,370,817 | A | 2/1983 | Ratanangsu |
| 4,372,059 | A | 2/1983 | Ambrose |
| 4,398,357 | A | 8/1983 | Batra |
| 4,399,620 | A | 8/1983 | Funck |
| D272,294 | S | 1/1984 | Watanabe |
| 4,449,306 | A | 5/1984 | Cavanagh |
| 4,451,994 | A | 6/1984 | Fowler |
| 4,454,662 | A | 6/1984 | Stubblefield |
| 4,455,765 | A | 6/1984 | Sjöswärd |
| 4,455,767 | A | 6/1984 | Bergmans |
| 4,468,870 | A | 9/1984 | Sternberg |
| 4,484,397 | A | 11/1984 | Curley, Jr. |
| 4,494,321 | A | 1/1985 | Lawlor |
| 4,505,055 | A | 3/1985 | Bergmans |
| 4,506,462 | A | 3/1985 | Cavanagh |
| 4,521,979 | A | 6/1985 | Blaser |
| 4,527,345 | A | 7/1985 | Lopez Lopez |
| D280,568 | S | 9/1985 | Stubblefield |
| 4,542,598 | A | 9/1985 | Misevich et al. |
| 4,546,559 | A | 10/1985 | Dassler |
| 4,557,059 | A | 12/1985 | Misevich et al. |
| 4,559,723 | A | 12/1985 | Hamy et al. |
| 4,559,724 | A | 12/1985 | Norton |
| 4,561,195 | A | 12/1985 | Onoda et al. |
| 4,577,417 | A | 3/1986 | Cole |
| 4,578,882 | A | 4/1986 | Talarico, II |
| 4,580,359 | A | 4/1986 | Kurrash et al. |
| 4,624,061 | A | 11/1986 | Wezel et al. |
| 4,624,062 | A | 11/1986 | Autry |
| 4,641,438 | A | 2/1987 | Laird et al. |
| 4,642,917 | A | 2/1987 | Ungar |
| 4,651,445 | A | 3/1987 | Hannibal |
| D289,341 | S | 4/1987 | Turner |
| 4,670,995 | A | 6/1987 | Huang |
| 4,676,010 | A | 6/1987 | Cheskin |
| 4,694,591 | A | 9/1987 | Banich et al. |
| 4,697,361 | A | 10/1987 | Ganter et al. |
| D293,275 | S | 12/1987 | Bua |
| 4,715,133 | A | 12/1987 | Hartjes et al. |
| 4,724,622 | A | 2/1988 | Mills |
| D294,425 | S | 3/1988 | Le |
| 4,727,660 | A | 3/1988 | Bernhard |
| 4,730,402 | A | 3/1988 | Norton et al. |
| 4,731,939 | A | 3/1988 | Parracho et al. |
| 4,747,220 | A | 5/1988 | Autry et al. |
| D296,149 | S | 6/1988 | Diaz |

| | | | |
|---|---|---|---|
| D296,152 | S | 6/1988 | Selbiger |
| 4,748,753 | A | 6/1988 | Ju |
| 4,754,561 | A | 7/1988 | Dufour |
| 4,756,098 | A | 7/1988 | Boggia |
| 4,757,620 | A | 7/1988 | Tiitola |
| 4,759,136 | A | 7/1988 | Stewart et al. |
| 4,768,295 | A | 9/1988 | Ito |
| 4,769,926 | A | 9/1988 | Meyers |
| D298,684 | S | 11/1988 | Pitchford |
| 4,785,557 | A | 11/1988 | Kelley et al. |
| 4,817,304 | A | 4/1989 | Parker et al. |
| 4,827,631 | A | 5/1989 | Thornton |
| 4,833,795 | A | 5/1989 | Diaz |
| 4,837,949 | A | 6/1989 | Dufour |
| D302,900 | S | 8/1989 | Kolman et al. |
| 4,854,057 | A | 8/1989 | Misevich et al. |
| 4,858,340 | A | 8/1989 | Pasternak |
| 4,866,861 | A | 9/1989 | Noone |
| 4,876,807 | A | 10/1989 | Tiitola et al. |
| 4,890,398 | A | 1/1990 | Thomasson |
| 4,894,933 | A | 1/1990 | Tonkel et al. |
| 4,897,936 | A | 2/1990 | Fuerst |
| 4,906,502 | A | 3/1990 | Rudy |
| 4,922,631 | A | 5/1990 | Anderie |
| 4,934,070 | A | 6/1990 | Mauger |
| 4,934,073 | A | 6/1990 | Robinson |
| D310,131 | S | 8/1990 | Hase |
| D310,132 | S | 8/1990 | Hase |
| 4,947,560 | A | 8/1990 | Fuerst et al. |
| 4,949,476 | A | 8/1990 | Anderie |
| D310,906 | S | 10/1990 | Hase |
| 4,982,737 | A | 1/1991 | Guttmann |
| 4,989,349 | A | 2/1991 | Ellis, III |
| D315,634 | S | 3/1991 | Yung-Mao |
| 5,010,662 | A | 4/1991 | Dabuzhsky et al. |
| 5,014,449 | A | 5/1991 | Richard et al. |
| 5,024,007 | A | 6/1991 | DuFour |
| 5,025,573 | A | 6/1991 | Giese et al. |
| D320,302 | S | 10/1991 | Kiyosawa |
| 5,052,130 | A | 10/1991 | Barry et al. |
| 5,077,916 | A | 1/1992 | Beneteau |
| 5,079,856 | A | 1/1992 | Truelsen |
| 5,092,060 | A | 3/1992 | Frachey et al. |
| D327,164 | S | 6/1992 | Hatfield |
| D327,165 | S | 6/1992 | Hatfield |
| 5,131,173 | A | 7/1992 | Anderie |
| D328,968 | S | 9/1992 | Tinker |
| D329,528 | S | 9/1992 | Hatfield |
| D329,739 | S | 9/1992 | Hatfield |
| D330,972 | S | 11/1992 | Hatfield et al. |
| D332,344 | S | 1/1993 | Hatfield et al. |
| D332,692 | S | 1/1993 | Hatfield et al. |
| 5,191,727 | A | 3/1993 | Barry et al. |
| 5,224,280 | A | 7/1993 | Preman et al. |
| 5,224,810 | A | 7/1993 | Pitkin |
| 5,237,758 | A | 8/1993 | Zachman |
| D347,105 | S | 5/1994 | Johnson |
| 5,317,819 | A | 6/1994 | Ellis, III |
| 5,369,896 | A | 12/1994 | Frachey et al. |
| D372,114 | S | 7/1996 | Tunre et al. |
| 5,543,194 | A | 8/1996 | Rudy |
| 5,544,429 | A | 8/1996 | Ellis, III |
| 5,572,805 | A | 11/1996 | Giese et al. |
| D388,594 | S | 1/1998 | Turner et al. |
| D409,362 | S | 5/1999 | Turner et al. |
| D409,826 | S | 5/1999 | Turner et al. |
| D410,138 | S | 5/1999 | Turner et al. |
| 5,909,948 | A | 6/1999 | Ellis, III |
| 6,115,941 | A | 9/2000 | Ellis, III |
| 6,115,945 | A | 9/2000 | Ellis, III |
| 6,163,982 | A | 12/2000 | Ellis, III |
| D444,293 | S | 7/2001 | Turner et al. |
| 6,295,744 | B1 | 10/2001 | Ellis, III |
| 6,308,439 | B1 | 10/2001 | Ellis, III |
| D450,916 | S | 11/2001 | Turner et al. |
| 6,314,662 | B1 | 11/2001 | Ellis, III |

FOREIGN PATENT DOCUMENTS

| | | |
|---|---|---|
| CA | 1 138 194 | 12/1982 |
| CA | 1 176 458 | 10/1984 |
| DE | B 23257 VII/71 A | 5/1956 |
| DE | 1 888 119 | 12/1963 |
| DE | 1918131 | 6/1965 |
| DE | 1918132 | 6/1965 |
| DE | 1 287 477 | 1/1969 |
| DE | 1290844 | 3/1969 |
| DE | 2036062 | 7/1970 |
| DE | 1948620 | 5/1971 |
| DE | 1685293 | 7/1971 |
| DE | 1 685 260 | 10/1971 |
| DE | 2045430 | 3/1972 |
| DE | 2522127 | 11/1976 |
| DE | 2525613 | 12/1976 |
| DE | 2602310 | 7/1977 |
| DE | 2613312 | 10/1977 |
| DE | 27 06 645 | 8/1978 |
| DE | 2654116 | 1/1979 |
| DE | 27 37 765 | 3/1979 |
| DE | 28 05 426 | 8/1979 |
| DE | 3021936 | 4/1981 |
| DE | 30 24 587 A1 | 1/1982 |
| DE | 8219616.8 | 9/1982 |
| DE | 3113295 | 10/1982 |
| DE | 32 45 182 | 5/1983 |
| DE | 33 17 462 | 10/1983 |
| DE | 831831.7 | 12/1984 |
| DE | 8431831 | 12/1984 |
| DE | 3347343 | 7/1985 |
| DE | 8530136.1 | 2/1988 |
| DE | 36 29 245 | 3/1988 |
| EP | 0 048 965 | 4/1982 |
| EP | 0 083 449 A1 | 7/1983 |
| EP | 0 130 816 | 1/1985 |
| EP | 0 185 781 | 7/1986 |
| EP | 0207063 | 10/1986 |
| EP | 0 206 511 | 12/1986 |
| EP | 0 213 257 | 3/1987 |
| EP | 0 215 974 | 4/1987 |
| EP | 0 238 995 | 9/1987 |
| EP | 0 260 777 | 3/1988 |
| EP | 0 301 331 A2 | 2/1989 |
| EP | 0 329 391 | 8/1989 |
| EP | 0 410 087 A2 | 1/1991 |
| FR | 602.501 | 3/1926 |
| FR | 925.961 | 9/1947 |
| FR | 1.004.472 | 3/1952 |
| FR | 1245672 | 10/1960 |
| FR | 1.323.455 | 2/1963 |
| FR | 2 006 270 | 11/1971 |
| FR | 2 261 721 | 9/1975 |
| FR | 2 511 850 | 3/1983 |
| FR | 2 622 411 | 5/1989 |
| GB | 9 591 | 0/1913 |
| GB | 16143 | 9/1891 |
| GB | 764956 | 1/1957 |
| GB | 807305 | 1/1959 |
| GB | 1504615 | 3/1978 |
| GB | 2 023 405 | 1/1980 |
| GB | 2 039 717 | 8/1980 |
| GB | 2076633 | 12/1981 |
| GB | 2133668 | 8/1984 |
| GB | 2 136 670 | 9/1984 |
| JP | 39-15597 | 8/1964 |
| JP | 45-5154 | 3/1970 |
| JP | 50-71132 | 11/1975 |

| | | |
|---|---|---|
| JP | 57-139333 | 8/1982 |
| JP | 4-279102 | 10/1982 |
| JP | 59-23525 | 7/1984 |
| JP | 61-55810 | 4/1986 |
| JP | 1129505 | 6/1986 |
| JP | 61-167810 | 10/1986 |
| JP | 1-195803 | 8/1989 |
| JP | 2136505 | 5/1990 |
| JP | 2279103 | 11/1990 |
| JP | 3-85102 | 4/1991 |
| JP | 3086101 | 4/1991 |
| JP | 5-123204 | 5/1993 |
| NZ | 189890 | 4/1981 |
| WO | WO87/07480 | 12/1987 |
| WO | WO8707481 | 12/1987 |
| WO | WO88/08263 | 11/1988 |
| WO | WO89/06500 | 7/1989 |
| WO | WO90/00358 | 1/1990 |
| WO | WO91/00698 | 1/1991 |
| WO | WO91/03180 | 3/1991 |
| WO | WO91/04683 | 4/1991 |
| WO | WO91/05491 | 5/1991 |
| WO | WO91/10377 | 7/1991 |
| WO | WO91/11124 | 8/1991 |
| WO | WO91/11924 | 8/1991 |
| WO | WO91/19429 | 12/1991 |
| WO | WO92/07483 | 5/1992 |
| WO | WO92/18024 | 10/1992 |
| WO | WO93/13928 | 7/1993 |
| WO | WO94/03080 | 2/1994 |
| WO | WO97/00029 | 1/1997 |
| WO | WO 00/54616 | 9/2000 |
| WO | WO 00/64293 | 11/2000 |
| WO | WO 01/80678 A2 | 11/2001 |

OTHER PUBLICATIONS

Fixx, *The Complete Book of Running*, pp. 134-137 1977.
Romika Catalog, Summer 1978.
Adidas shoe, Model << Water Competition >> 1980.
World Professional Squash Association Pro Tour Program, 1982-1983.
Williams et al., << The Mechanics of Foot Action During The GoldSwing and Implications for Shoe Design >>, *Medicine and Science in Sports and Exercise*, vol. 15, No. 3, pp. 247-255 1983.
Nigg et al., <<Biomechanical Aspects of Sport Shoes and Playing Surfaces >>, *Proceedings of the International Symposium on Biomechanical Aspects of Sport Shoes and Playing Surfaces*, 1983.
Valiant et al., <<A Study of Landing from a Jump : Implications for the Design of a Basketball Shoe >>, *Scientific Program of IX Internatioanl Congress of Biomechanics*, 1983.
Frederick, *Sports Shoes and Playing Surfaces, Biomechanical Properties*, Entire Book, 1984.
Saucony Spot-bilt Catalog Supplement, Spring 1985.
Adidas shoe, Model << Fire >> 1985.
Adidas shoe, Model "Tolio H.", 1985.
Adidas shoe, Model "Buffalo" 1985.
Adidas shoe, Model, "Marathon 86" 1985.
Adidas shoe, Model << Boston Super >> 1985.
Leuthi et al., <<Influence of Shoe Construction on Lower Extremity Kinematics and Load During Lateral Movements In Tennis >>, *International Journal of Sport Biomechanics*. , vol. 2, pp. 166-174 1986.
Nigg et al., *Biomechanics of Running Shoes*, entire book, 1986.
Runner's World, Oct. 1986.
AVIA Catalog 1986.
Brooks Catalog 1986.
Adidas Catalog 1986.
Adidas shoe, Model <<Questar >>, 1986.
Adidas shoe, Model "London" 1986.
Adidas shoe, Model << Marathon >> 1986.
Adidas shoe, Model << Tauern >> 1986.
Adidas shoe, Model << Kingscup Indoor >>, 1986.
Komi et al., "Interaction Between Man and Shoe in Running: Considerations for More Comprehensive Measurement Approach", *International Journal of Sports Medicine*, vol. 8, pp. 196-202 1987.
Nigg et al., << The Influence of Lateral Heel Flare of Running Shoes on Protraction and Impact Forces >>, *Medicine and Science in Sports and Exercise*, vol. 19, No. 3, pp. 294-302 1987.
Nigg, << Biomechanical Analysis of Ankle and foot Movement >> *Medicine and Sport Science*, vol. 23, pp. 22-29 1987.
Saucony Spot-bilt shoe, *The Complete Handbook of Athletic Footwear*, pp. 332, 1987.
Puma basketball shoe, *The Complete Handbook of Athletic Footwear*, pp. 315, 1987.
Adidas shoe, Model, << Indoor Pro >> 1987.
Adidas Catalog, 1987.
Adidas Catalog, Spring 1987.
Nike Fall Catalog 1987, pp. 50-51.
Footwear Journal, Nike Advertisement, Aug. 1987.
Sporting Goods Business, Aug. 1987.
Nigg et al., "Influence of Hell Flare and Midsole Construction on Pronation" *International Journal of Sport Biomechanics*, vol. 4, No. 3, pp. 205-219, (1987).
Vagenas et al., << Evaluationm of Rearfoot Asymmetrics in Running With Worn and New Running Shoes << , *International Journal of Sport Biomechanics*, vol. 4, No. 4, pp. 342-357 (1988).
Fineagan, "Comparison of the Effects of a Running Shoe and A Racing Flat on the Lower Extremity Biomechanical Alignment of Runners", *Journal of the American Physical Therapy Association*, vol. 68, No. 5, p. 806 (1988).
Nawoczenside et al., << Effect of Rocker Sole Design on Plantar Forefoot Pressures >> *Journal of the American Podiatric Medical Association*, vol. 79, No. 9, pp. 455-460, 1988.
Sprts Illustrated, Special Preview Issue, The Summer Olympics << Seoul '88 >> Reebok Advertisetment.
Sports Illustrated, Nike Advertisement, Aug. 8, 1988.
Runner's World, "Shoe Review" Nov. 1988 pp. 46-74.
Footwear Nows, Special Supplement, Feb. 8, 1988.
Footwear New, vol. 44, No. 37, Nike Advertisement (1988).
Saucony Spot-bilt Catalog 1988.
Runner's World, Apr. 1988.
Footwear News, Special Supplement, Feb. 8, 1988.
Kronos Catalog, 1988.
Avia Fall Catalog 1988.
Nike shoe, Model << High Jump 88 >>, 1988.
Nike shoe, Model << Zoom Street Leather >> 1988.
Nike shoe, Model, << Leather Cortex® >>, 1988.
Nike shoe, Model << Air Revolution >> #15075, 1988.
Nike shoe, Model "Air Force" #1978, 1988.
Nike shoe, Model << Air Flow << #718, 1988.
Nike shoe, Model "Air" #1553, 1988.
Nike shoe, Model << Air >>, #13213 1988.
Nike shoe, Model << Air >>, #4183, 1988.
Nike Catalog, Footwear Fall, 1988.
Adidas shoe Model "Skin Racer" 1988.
Adidas shoe, Model <<Tennis Comfort >> 1988.
Adidas Catalog 1988.
Segesser et al., "Surfing Shoe", *The Shoe in Sport*, 1989, (Translation of a book published in Germany in 1987), pp. 106-110.
Palamarchuk et al., "In shoe Casting Technique for Specialized Sports Shoes", *Journal of the America, Podiatric Medical Association*, vol. 79, No. 9, pp. 462-465 1989.
Runner's World, "Spring Shoe Survey", pp. 45-74.
Footwear News, vol. 45, No. 5, Nike Advertisement 1989.
Nike Spring Catalog 1989 pp. 62-63.
Prince Cross-Sport 1989.
Adidas Catalog 1989.
Adidas Spring Catalog 1989.
Adidas Autumn Catalog 1989.
Nike Shoe, men's cross-training Model "Air Trainer SC" 1989.
Nike shoe, men's cross-training Model << Air Trainer TW >> 1989.
Adidas shoe, Model "Torsion Grand Slam Indoor", 1989.
Adidas shoe, Model << Torsion ZC 9020 S >> 1989.
Adidas shoe, Model << Torison Special HI >> 1989.

Areblad et al., << Three-Dimensional Measurement of Rearfoot Motion During Running >> *Journal of Biomechanics*, vol. 23, pp. 933-940 (1990).
Cavanagh et al., "Biomechanics of Distance Running", Human Kinetics Books, pp. 155-164 1990.
Adidas Catalog 1990.
Adidas Catalog 1991.
K-Swiss Catalog, Fall 1991.
Adidas' First Supplemental Responses to Interrogatory No. 1.
Complaint, *Anatomic Research, Inc. and Frampton E. Ellis* v. *adidas America, Inc.* Civil Action No. 01-1781-A.
Answer and Counterclaim of Defendant adidas America, Inc., *Anatomic Research, Inc. And Frampton E. Ellis* v. *adidas America, Inc.* Civil Action No. 01-1781-A dated Dec. 14, 2001.
Complaint, *Anatomic Research, Inc.* V. *adidas America, Inc. Adidas Salomon North America, Inc. Adidas Sales, Inc. And adidas Promotional Retail Operations, Inc.* Civil Action No. 2 :01cv960.
Answer and Counterclaim, *Anatomic Research, Inc.* V. *adidas America, Inc. Adidas Salomon North America, Inc. Adidas Sales, Inc. And adidas Promotional Retail Operations, Inc.* Civil Action No. 2 :01cv960 dated Jan. 14, 2002.
*Adidas America, Inc.* v. *Anatomic Research, Inc. and Frampton E. Ellis, III, adidas America Inc.'s* Respouses to Defendants' First Set of Interrogatories dated Jan. 28, 2002.
Adidas' Second Supplemental Reponses to Interrogatory No. 1.
Original specification filed in U.S. Appl. No. 09/908,688, filed Jul. 20, 2001 available upon request (ELL 2.6).
Original specification filed in U.S. Appl. No. 09/907,598, filed Jul. 19, 2001 available upon request (ELL-012D/Div 3).
Original specification filed in U.S. Appl. No. 09/974,943, filed Oct. 12, 2001 available upon request (ELL-012D/Div 4).
Original specification filed in U.S. Appl. No. 09/974,786, filed Oct. 12, 2001 available upon request (ELL-012D/Div 5).
Original specification filed in U.S. Appl. No. 09/974,794, filed Oct. 12, 2001 available upon request (ELL-012D/Div 6).
Original specification filed in U.S. Appl. Nos. 08/452,490 and 08/473,974 on May 30, 1995 and Jun. 7, 1995, respectively, available upon request (ELL-004/Con 3 and ELL-012M).
Williams, Walking on Air, *Case Alumnus*, vol. LXVII, No. 6, Fall 1989, pp. 4-8.
Brooks advertisement in *Runner's World* etc., Jun. 1989, pp. 56+.
Nigg et al., Influence of Heel Flare and Midsole Construction on Pronation, Supination, and Impact Forces for Heel-Toe Running, *International Journal of Sports Biomechanics*, 1988, 4, pp. 205-219.
Nigg et al., The influence of lateral heel flare of running shoes on pronation and impact forces, *Medicine and Science in Sports and Exercise*, vol. 19, No. 3, 1987, pp. 294-302.
Cavanagh et al., Biological Aspects of Modeling Shoe/Foot Interaction During Running, *Sport Shoes and Playing Surfaces*, 1984, pp. 24-25, 32-35, 46.
Blechschmidt, The Structure of the Calcaneal Padding, *Foot & Ankle*, vol. 2, No. 5, Mar. 1982, pp. 260-283.
Cavanagh, *The Running Shoe Book*, © 1980, pp. 176-180, Anderson World, Inc., Mountain View, CA.
Executive Summary with seven figures.
The Reebok Lineup Fall 1987 (2 pages).
German description of adidas badminton shoes, pre-1989(?).
Originally filed Specification for U.S. Appl. Mo. 09/522,174, filed Mar. 9 2000 (ELL-002.5).
Originally filed Specification for U.S. Appl. No. 08/477,640, filed Jun. 7, 1995 (ELL-009/Con).
Originally filed Specification for U.S. Appl. No. 09/648,792, filed Aug. 28, 2000 (ELL-010/Con).
Originally filed Specification for U.S. Appl. No. 08/376,661, filed Jan. 23, 1995 (ELL-003/Con 3).
Originally filed Specification for U.S. Appl. No. 09/710,952, filed Nov. 14, 2000 (ELL-003/Div 1).
Originally filed Specification for U.S. Appl. No. 09/780,450, filed Feb. 12, 2001 (ELL-003/Div 2).
Originally filed Specification for U.S. Appl. No. 09/790,626, filed Feb. 23, 2001 (ELL-003/Div 3).
Originally filed Specification for U.S. Appl. No. 09/734,905, filed Dec. 13, 2000 (ELL-012D/Div 1).
Originally filed Specification for U.S. Appl. No. 09/785,200, filed Feb. 20, 2001 (ELL-012D/Con 2).
Originally filed Specification for U.S. Appl. No. 08/482,838, filed Jun. 7, 1995 (ELL-011).
Originally filed Specification for U.S. Appl. No. 08/033,468, filed Mar. 18, 1993 (ELL-006/Con).
Originally filed Specification for U.S. Appl. No. 08/479,776, filed Jun. 7, 1995 (ELL-014B).
Originally filed Specification for U.S. Appl. No. 08/462,531, filed Jun. 5, 1995 (ELL-012AA).
Originally filed Specification for U.S. Appl. No. 08/473,212, filed Jun. 7, 1995 (ELL-012B).

CORRECTIVE SHOE SOLE STRUCTURES USING A CONTOUR GREATER THAN THE THEORETICALLY IDEAL STABILITY PLANE

CROSS-REFERENCE TO RELATED APPLICATIONS

This application is a continuation of U.S. patent application Ser. No. 09/993,665 filed Nov. 27, 2001, abandoned, which is a continuation of U.S. patent application Ser. No. 08/452,490, filed May 30, 1995, now U.S. Pat. No. 6,360,453 which is a continuation of U.S. patent application Ser. No. 08/142,120, filed Oct. 28, 1993, now abandoned, which is a continuation of U.S. application Ser. No. 07/830,747, filed Feb. 7, 1992, now abandoned, which is continuation of U.S. application Ser. No. 07/416,478, filed Oct. 3, 1989, now abandoned.

BACKGROUND OF THE INVENTION

This invention relates generally to the structure of shoes. More specifically, this invention relates to the structure of running shoes. Still more particularly, this invention relates to variations in the structure of such shoes having a sole contour which follows a theoretically ideal stability plane as a basic concept, but which deviates therefrom outwardly, to provide greater than natural stability. Still more particularly, this invention relates to the use of structures approximating, but increasing beyond, a theoretically ideal stability plane to provide greater than natural stability for an individual whose natural foot and ankle biomechanical functioning have been degraded by a lifetime use of flawed existing shoes.

Existing running shoes are unnecessarily unsafe. They seriously disrupt natural human biomechanics. The resulting unnatural foot and ankle motion leads to what are abnormally high levels of running injuries.

Proof of the unnatural effect of shoes has come quite unexpectedly from the discovery that, at the extreme end of its normal range of motion, the unshod bare foot is naturally stable, almost unsprainable while the foot equipped with any shoe, athletic or otherwise, is artificially unstable and abnormally prone to ankle sprains. Consequently, ordinary ankle sprains must be viewed as largely an unnatural phenomena, even though fairly common. Compelling evidence demonstrates that the stability of bare feet is entirely different from the stability of shoe-equipped feet.

The underlying cause of the universal instability of shoes is a critical but correctable design flaw. That hidden flaw, so deeply ingrained in existing shoe designs, is so extraordinarily fundamental that it has remained unnoticed until now. The flaw is revealed by a novel new biomechanical test, one that is unprecedented in its simplicity. The test simulates a lateral ankle sprain while standing stationary. It is easy enough to be duplicated and verified by anyone: it only takes a few minutes and requires no scientific equipment or expertise.

The simplicity of the test belies its surprisingly convincing results. It demonstrates an obvious difference in stability between a bare foot and a running shoe, a difference so unexpectedly huge that it makes an apparently subjective test clearly objective instead. The test proves beyond doubt that all existing shoes are unsafely unstable.

The broader implications of this uniquely unambiguous discovery are potentially far-reaching. The same fundamental flaw in existing shoes that is glaringly exposed by the new test also appears to be the major cause of chronic overuse injuries, which are unusually common in running, as well as other sport injuries. It causes the chronic injuries in the same way it causes ankle sprains; that is, by seriously disrupting natural foot and ankle biomechanics.

The applicant has introduced into the art the concept of a theoretically ideal stability plane as a structural basis for shoe sole designs. That concept as implemented into shoes such as street-shoes and athletic shoes is presented in pending U.S. applications Ser. Nos. 07/219,387, filed on Jul. 15, 1958; Ser. No. 07/239,667, filed on Sep. 2, 1988; and Ser. No. 07/400,714, filed an Aug. 30, 1989, as well as in PCT Application No. PCT/US89/03076 filed on Jul. 14, 1989. The purpose of the theoretically ideal stability plane as described in these applications was primarily to provide a neutral design that allows for natural foot and ankle biomechanics as close as possible to that between the foot and the ground, and to avoid the serious interference with natural foot and ankle biomechanics inherent in existing shoes.

This new invention is a modification of the inventions disclosed and claimed in the earlier application and develops the application of the concept of the theoretically ideal stability plans to other shoe structures. As Such, it presents certain structural ideas which deviate outwardly from the theoretically ideal stability plane to compensate for faulty foot biomechanics caused by the major flaw in existing shoe designs identified in the earlier patent applications.

The shoe sole designs in this application are based on a recognition that lifetime use of existing shoes, the unnatural design of which is innately and seriously flawed, has produced actual structural changes in the human foot and ankle Existing shoes thereby have altered natural human biomechanics in many, if not most, individuals to an extent that must be compensated for in an enhanced and therapeutic design. The continual repetition of serious interference by existing shoes appears to have produced individual biomechanical changes that may be permanent, so simply removing the cause is not enough. Treating the residual effect must also be undertaken.

Accordingly, it is a general object of this invention to elaborate upon the application of the principle of the theoretically ideal stability plane to other shoe structures.

It is still another object of this invention to provide a shoe having a sole contour which deviates outwardly in a constructive way from the theoretically ideal stability plane.

It is another object of this invention to provide a sole contour having a shape naturally contoured to the shape of a human foot, but having a shoe sole thickness which is increases somewhat beyond the thickness specified by the theoretically ideal stability plane.

It is another object of this invention to provide a naturally contoured shoe sole having a thickness somewhat greater than mandated by the concept of a theoretically ideal stability plane, either through most of the contour of the sole, or a preselected portions of the sole.

It is yet another object of this invention to provide a naturally contoured shoe sole having a thickness which approximates a theoretically ideal stability plane, but which varies toward either a greater thickness throughout the sole or at spaced portions thereof, or toward a similar but less or thickness.

These and other objects of the invention will become apparent from a detailed description of the invention which follows taken with the accompanying drawings.

BRIEF SUMMARY OF THE INVENTION

Directed to achieving the aforementioned objects and to overcoming problems with prior art shoes, a shoe according to the invention comprises a sole having at least a portion thereof following approximately the contour of a theoretically ideal stability plane, preferably applied to a naturally contoured shoe sole approximating the contour of a human foot.

In another aspect, the shoe includes a naturally contoured sole structure exhibiting natural deformation which closely parallels the natural deformation of a foot under the same load, and having a contour which approximates, but increases beyond the theoretically ideal stability plane. When the shoe sole thickness is increased beyond the theoretically ideal stability plane, greater than natural stability results when thickness is decreased, greater than natural motion results.

In a preferred embodiment, such variations are consistent through all frontal plane cross sections so that there are proportionally equal increases to the theoretically ideal stability plane from front to back in alternative embodiments, the thickness may increase, then decrease at respective adjacent locations, or vary in other thickness sequences.

The thickness variations may be symmetrical on both sides, or asymmetrical, particularly since it may be desirable to provide greater stability for the medial side than the lateral side to compensate for common pronation problems. The variation pattern of the right shoe can vary from that of the left shoe. Variation in shoe sole density or bottom sole tread can also provide reduced but similar effects.

These and other features of the invention will become apparent from the detailed description of the invention which follows.

DETAILED DESCRIPTION OF THE PREFERRED EMBODIMENTS

Figure 1:
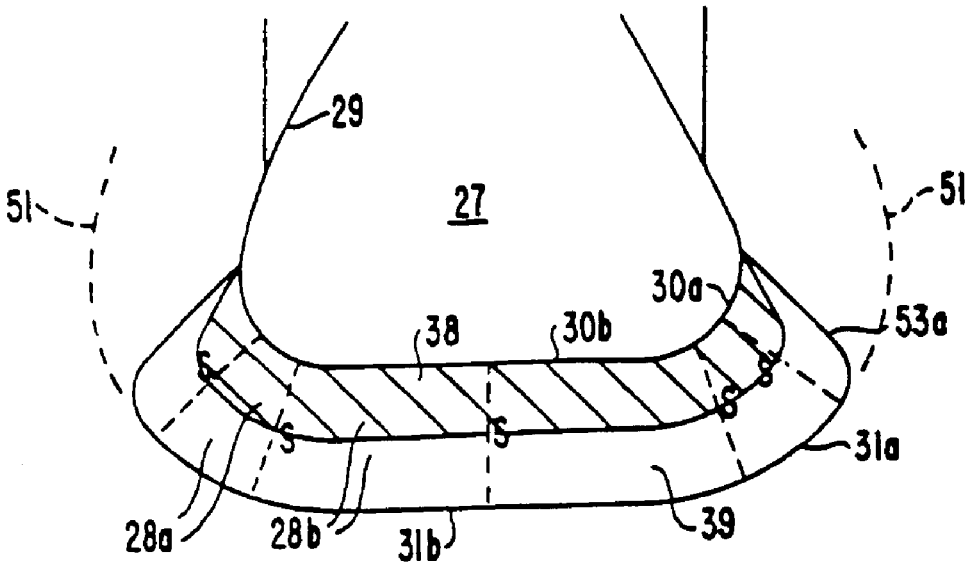
FIG. 1 shows, in frontal plane cross section at the heel portion of a shoe, the applicant's prior invention of a shoe sole with naturally contoured sides based on a theoretically ideal stability plane.
Figure 2:
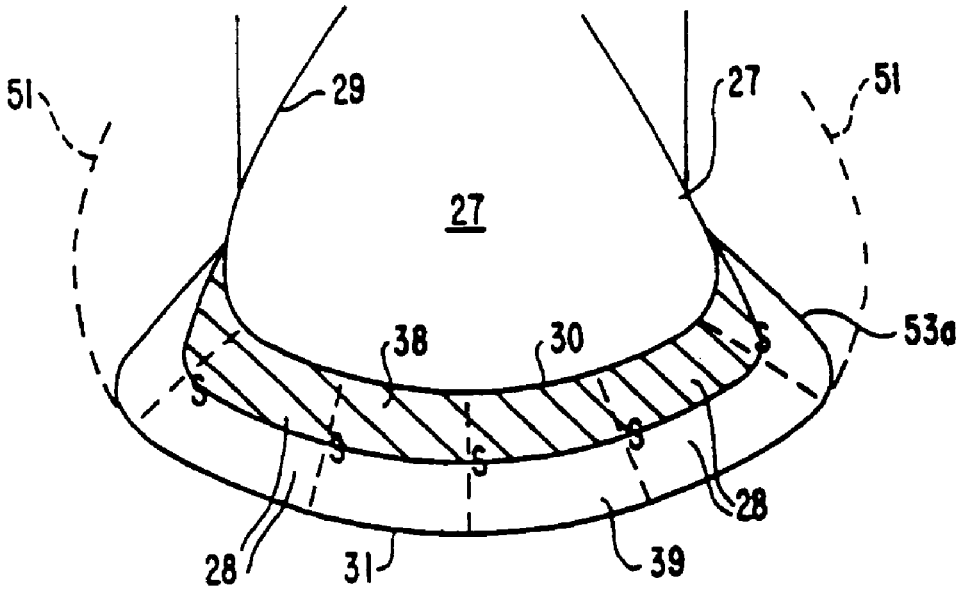
FIG. 2 shows, again in frontal plane cross section, the most general case of the applicant's prior invention, a fully contoured shoe sole that follows the natural contour of the bottom of the foot as well as its sides, also based on the theoretically ideal stability plane.
Figure 3A:
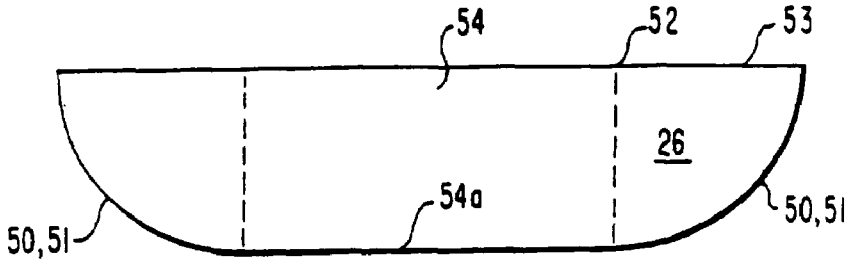
FIG. 3, as seen in FIGS. 3A to 3C in frontal plane cross section at the heel, shows the applicant's prior invention for conventional shoes, a quadrant-sided shoe sole, based on a theoretically ideal stability plane.
Figure 3B:
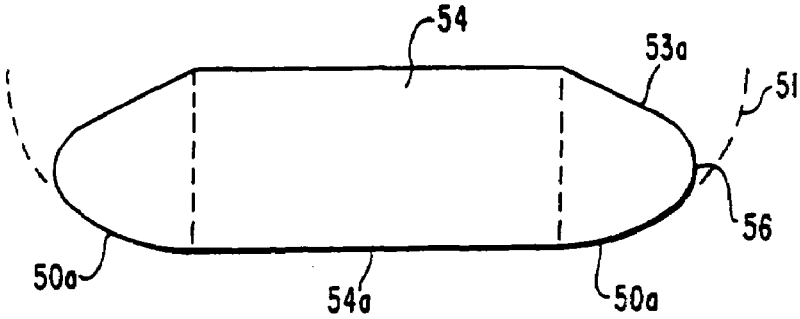
Figure 3C:
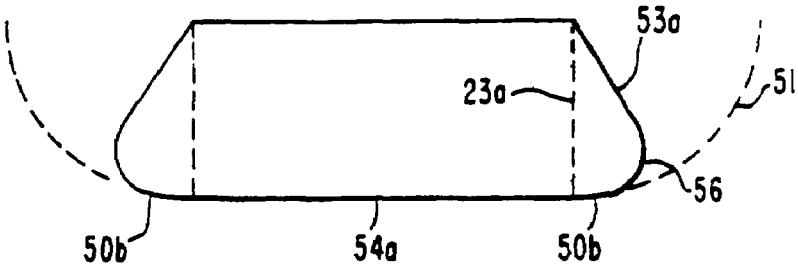
Figure 4:
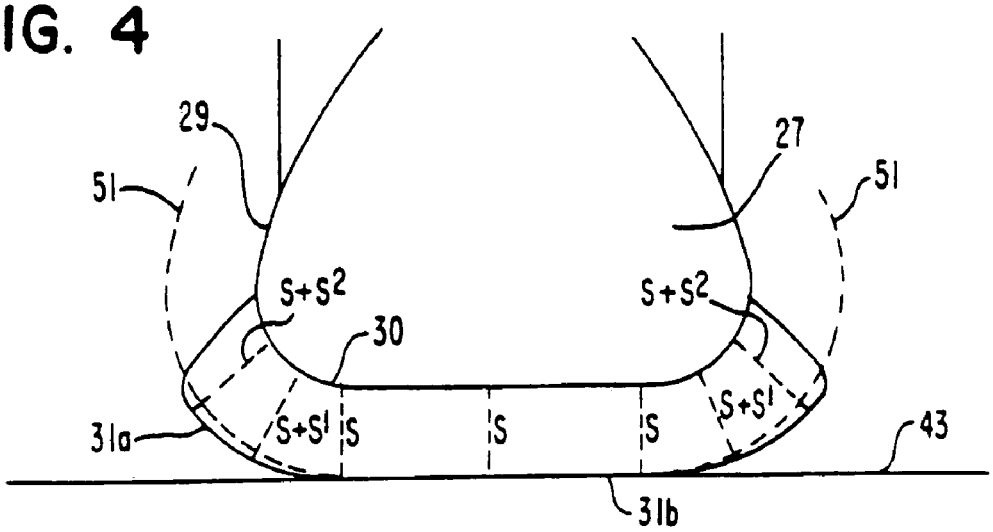
FIG. 4 shows a frontal plane cross section at the heel portion of a shoe with naturally contoured sides like those of FIG. 1, wherein a portion of the shoe sole thickness is increased beyond the theoretically ideal stability plane.

FIGS. 1, 2, and 3 show frontal plane cross sectional views of a shoe sole according to the applicant's prior inventions based on the theoretically ideal stability plane, taken at about the ankle joint to show the heel section of the shoe. FIGS. 4 through 13 show the same view of the applicant's enhancement of that invention. The reference numerals are like those used in the prior pending applications of the applicant mentioned above and which are incorporated by reference for the sake of completeness of disclosure, if necessary. In the figures, a foot 27 is positioned in a naturally contoured shoe having an upper 21 and a sole 28. The shoe sole normally contacts the ground 43 at about the lower central heel portion thereof, as shown in FIG. 4. The concept of the theoretically ideal stability plane, as developed in the prior applications as noted, defines the plane 51 in terms of a locus of points determined by the thickness (s) of the sole.

FIG. 1 shows, in a rear cross sectional view, the application of the prior invention showing the inner surface of the shoe sole conforming to the natural contour of the foot and the thickness of the shoe sole retaining constant in the frontal plane, so that the outer surface coincides with the theoretically ideal stability plane.

FIG. 2 shows a fully contoured shoe sole design of the applicant's prior invention that follows the natural contour of all of the foot, the bottom as well as the sides, while retaining a constant shoe sole thickness in the frontal plane.

The fully contoured shoe sole assumes that the resulting slightly rounded bottom when unloaded will deform under load and flatten just as the human foot bottom is slightly rounded unloaded but flattens under load: therefore, shoe sole material must be of such composition as to allow the natural deformation following that of the foot. The design applies particularly to the heel, but to the rest of the shoe sole as well. By providing the closest match to the natural shape of the foot, the fully contoured design allows the foot to function as naturally as possible. Under load, FIG. 2 would deform by flattening to look essentially like FIG. 1. Seen in this light, the naturally contoured side design in FIG. 1 is a more conventional, conservative design that is a special case of the more general fully contoured design in FIG. 2, which is the closest to the natural form of the foot, but the least conventional. The amount of deformation flattening used in the FIG. 1 design, which obviously varies under different loads, is not an essential element of the applicant's invention.

FIGS. 1 and 2 both show in frontal plane cross sections the essential concept underlying this invention, the theoretically ideal stability plane, which is also theoretically ideal for efficient natural motion of all kinds, including running, jogging or walking. FIG. 2 shows the most general case of the invention, the fully contoured design, which conforms to the natural shape of the unloaded foot. For any given individual, the theoretically ideal stability plane 51 is determined, first, by the desired shoe sole thickness (a) in a frontal plane cross section, and, second, by the natural shape of the individual's foot surface 29.

For the special case shown in FIG. 1, the theoretically ideal stability plane for any particular individual (or size average of individuals) is determined, first, by the given frontal plane cross section shoe sole thickness (s); second, by the natural shape of the individual's foot; and, third, by the frontal plane cross section width of the individual's load-bearing footprint 30*b*, which is defined as the upper surface of the shoe sole that is in physical contact with and supports the human foot sole.

The theoretically ideal stability plane for the special case is composed conceptually of two parts shown in FIG. 1, the first part is a line segment 31*b* of equal length and parallel to line 30*b* at a constant distance (s) equal to shoe sole thickness. This corresponds to a conventional shoe sole directly underneath the human foot, and also corresponds to the flattened portion of the bottom of the load-bearing foot sole 28*b*. The second part is the naturally contoured stability side outer edge 31*a* located at each side of the first part, line segment 31*b*. Each point on the Contoured side outer edge 31*a* is located at a distance which is exactly shoe sole thickness (s) from the closest point on the contoured side inner edge 30*a*.

In summary, the theoretically ideal stability plane is the essence of this invention because it is used to determine a geometrically precise bottom contour of the shoe sole based on a top contour that conforms to the contour of the foot. This invention specifically claims the exactly determined geometric relationship just described.

It can be stated unequivocally that any shoe sole contour, even of similar contour, that exceeds the theoretically ideal stability plane will restrict natural foot motion, while any less than that plane will degrade natural stability, in direct proportion to the amount of the deviation. The theoretical ideal was taken to be that which is closest to natural.

FIG. 3 illustrates in frontal plane cross section another variation of the applicant's prior invention that uses stabilizing quadrants 26 at the outer edge of a conventional shoe sole 28*b* illustrated generally at the reference numeral 28. The stabilizing quadrants would be abbreviated in actual embodiments.

FIG. 4 illustrates the applicant's new invention of shoe sole side thickness increasing beyond the theoretically ideal stability plane to increase stability somewhat beyond its natural level. The unavoidable trade-off resulting is that natural motion would be restricted somewhat and the weight of the shoe sole would increase somewhat.

FIG. 4 shows a situation wherein the thickness of the sole at each of the opposed sides is thicker at the portions of the sole 31*a* by a thickness which gradually varies continuously from a thickness (s) through a thickness (s+s1), to a thickness (s+s2).

These designs recognize that lifetime use of existing shoes, the design of which has an inherent flaw that continually disrupts natural human biomechanics, has produced thereby actual structural changes in a human foot and ankle to an extent that must be compensated for. Specifically, one of the most common of the abnormal effects of the inherent existing flaw is a weakening of the long arch of the foot, increasing pronation. These designs therefore modify the applicant's preceding designs to provide greater than natural stability and should be particularly useful to individuals, generally with low arches, prone to pronate excessively, and could be used only on the medial side. Similarly, individuals with high arches and a tendency to over supinate and lateral ankle sprains would also benefit, and the design could be used only on the lateral side. A shoe for the general population that compensate for both weaknesses in the same shoe would incorporate the enhanced stability of the design compensation on both sides.

The new design in FIG. 4, like FIGS. 1 and 2, allows the shoe sole to deform naturally closely paralleling the natural deformation of the barefoot underload; in addition, shoe sole material must be of such composition as to allow the natural deformation following that of the foot.

The new designs retain the essential novel aspect of the earlier designs; namely, contouring the shape of the shoe sole to the shape of the human foot. The difference is that the shoe sole thickness in the frontal plane is allowed to vary rather than remain uniformly constant. More specifically, FIGS. 4, 5, 6, 7, and 11 show, in frontal plane cross sections at the heel, that the shoe sole thickness can increase beyond the theoretically ideal stability plane 51, in order to provide greater than natural stability. Such variations (and the following variations) can be consistent through all frontal plane cross sections, so that there are proportionately equal increases to the theoretically ideal stability plane 51 from the front of the shoe 801*e* to the back, or that the thickness can vary, preferably continuously, from one frontal plane to the next.

The exact amount of the increase in shoe sole thickness beyond the theoretically ideal stability plane is to be determined empirically. Ideally, right and left shoe soles would be custom designed for each individual based on an biomechanical analysis of the extent of his or her foot and ankle disfunction in order to provide an optimal individual correction. If epidemiological studies indicate general corrective patterns for specific categories of individuals or the population as a whole, then mass-produced corrective shoes with soles incorporating contoured sides exceeding the theoretically ideal stability plane would be possible. It is expected that any such mass-produced corrective shoes for the general population would have thicknesses exceeding the theoretically ideal stability plane by an amount up to 5 or 10 percent, while more specific groups or individuals with more severe disfunction could have an empirically demonstrated need for greater corrective thicknesses on the order of up to 25 percent more than the theoretically ideal stability plane. The optimal contour for the increased thickness may also be determined empirically.

Figure 5:
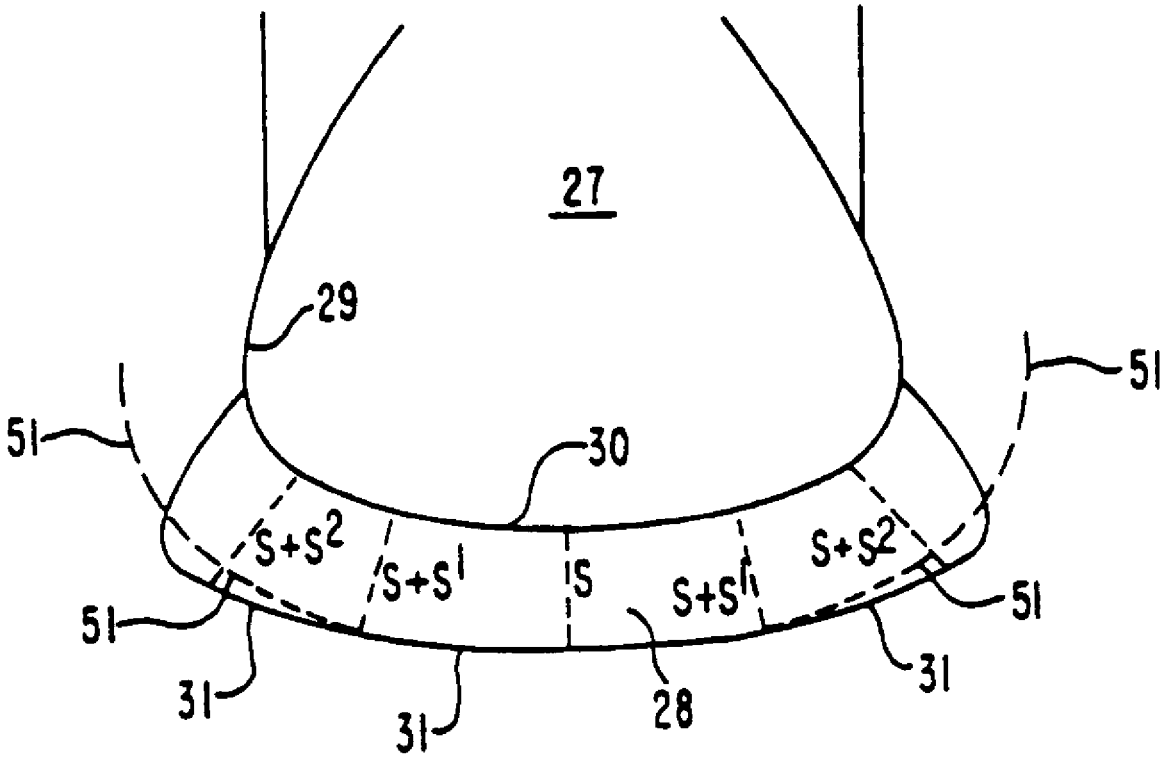
FIG. 5 is a view similar to FIG. 4, but of a shoe with fully contoured sides wherein the sole thickness increases with increasing distance from the center line of the ground-engaging portion of the sole.

FIG. 5 shows a variation of the enhanced fully contoured design wherein the shoe sole begins to thicken beyond the theoretically ideal stability plane 51 somewhat offset to the sides.

Figure 6:
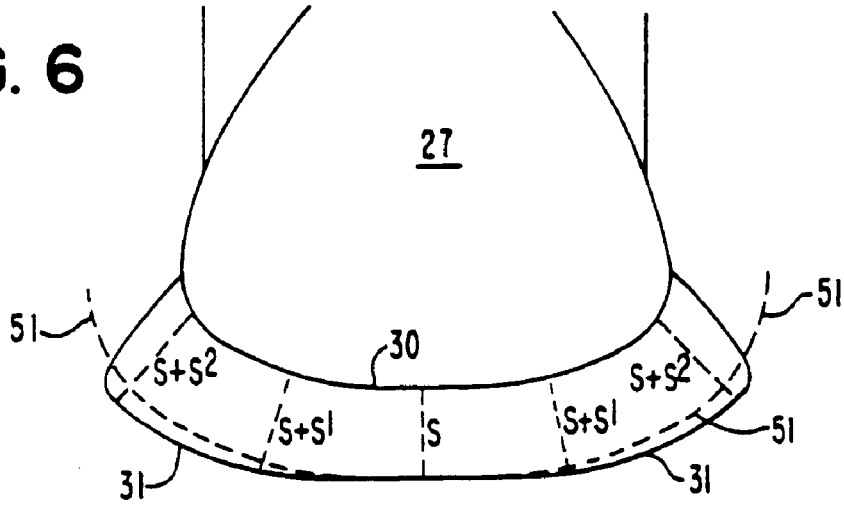
FIG. 6 is a view similar to FIG. 5 where the fully contoured sole thickness variations are continually increasing on each side.

FIG. 6 shows a thickness variation which is symmetrical as in the case of FIGS. 4 and 5, but wherein the shoe sole begins to thicken beyond the theoretically ideal stability plane 51 directly underneath the foot heel 27 on about a center line of the shoe sole. In fact, in this case the thickness of the shoe sole is the same as the theoretically ideal stability plane only at that beginning point underneath the upright foot. For the applicant's new invention where the shoe sole thickness varies, the theoretically ideal stability plane is determined by the least thickness in the shoe sole's direct load-bearing portion meaning that portion with direct tread contact on the ground; the outer edge or periphery of the shoe sole is obviously excluded, since the thickness there always decreases to zero. Note that the capability to deform naturally of the applicant's design may sake some portions of the shoe sole load-bearing when they are actually under a load, especially walking or running, even though they might not appear to be when not under a load.

Figure 7:
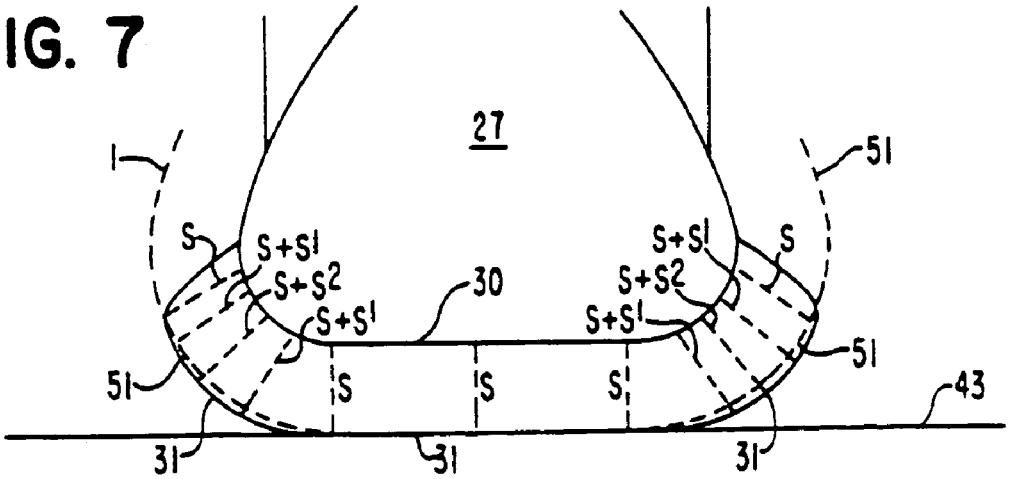
FIG. 7 is a view similar to FIGS. 4 to 6 wherein the sole thicknesses vary in diverse sequences.

FIG. 7 shows that the thickness can also increase and then decrease: other thickness variation sequences are also possible. The variation in side contour thickness in the new invention can be either symmetrical on both sides or asymmetrical, particularly with the medial side providing more stability than the lateral side, although many other asymmetrical variations are possible, and the pattern of the right foot can vary from that of the left foot.

FIGS. 8, 9, 10 and 12 show that similar variations in shoe midsole (other portions of the shoe sole area not shown) density can provide similar but reduced effects to the variations in shoe sole thickness described previously in FIGS. 4 through 7. The major advantage of this approach is that the structural theoretically ideal stability plane is retained, so that naturally optimal stability and efficient motion are retained to the maximum extent possible.

Figure 8:
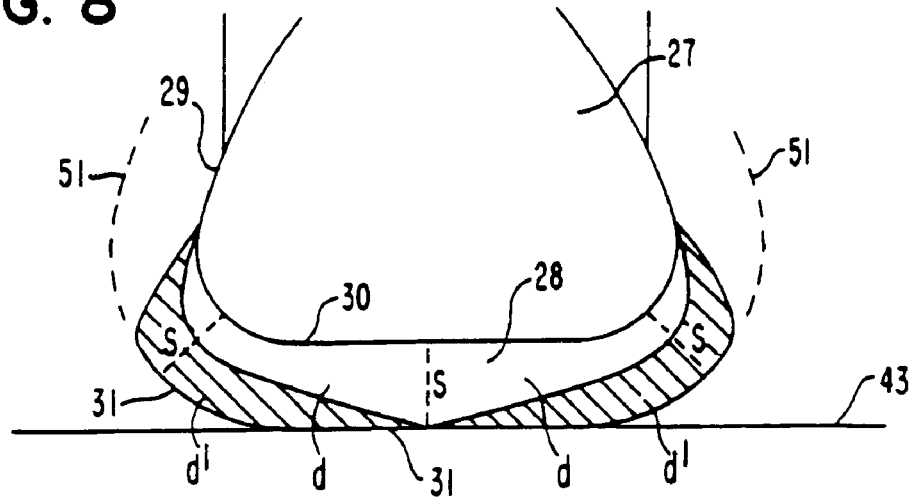
FIG. 8 is a frontal plane cross section showing a density variation in the midsole.
Figure 9:
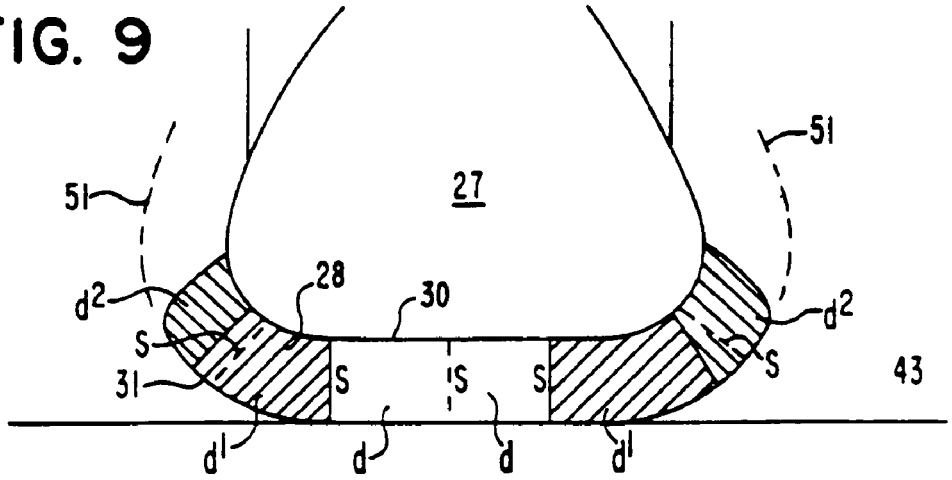
FIG. 9 is a view similar to FIG. 8 wherein the firmest density material is at the outermost edge of the midsole contour.

The forms of dual and tri-density midsoles shown in the figures are extremely common in the current art of running shoes, and any number of densities are theoretically possible, although an angled alternation of just two densities like that shown in FIG. 8 provides continually changing composite density. However, the applicant's prior invention did not prefer multi-densities in the midsole, since only a uniform density provides a neutral shoe sole design that does not interfere with natural foot and ankle biomechanics in the way that multi-density shoe soles do, which is by providing different amounts of support to different parts of the foot; it did not, of course, preclude such multi-density midsoles. In these figures, the density of the sole material designated by the legend (d1) is firmer than (d) while (d2) is the firmest of the three representative densities shown. In FIG. 8, a dual density sole is shown, with (d) having the less firm density.

It should be noted that shoe soles using a combination both of sole thicknesses greater than the theoretically ideal stability plane and of midsole densities variations like those just described are also possible but not shown.

Figure 10:
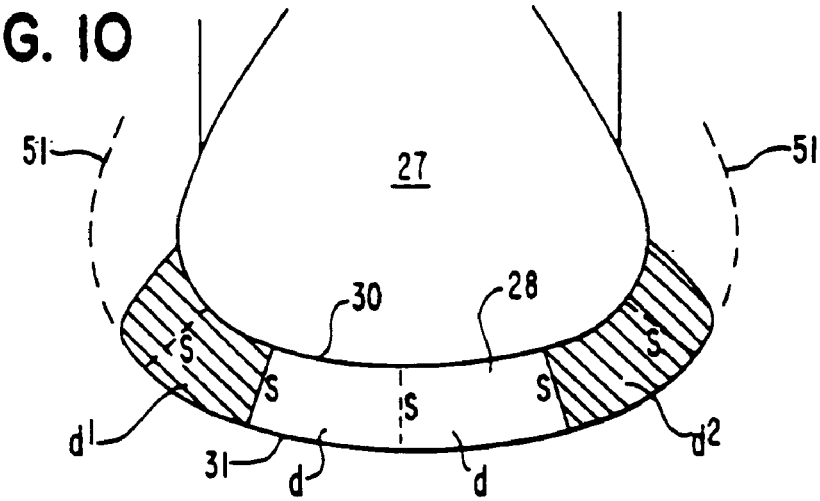
FIG. 10 is a view similar to FIGS. 8 and 9 showing still another density variation, one which is asymetrical.
Figure 11:
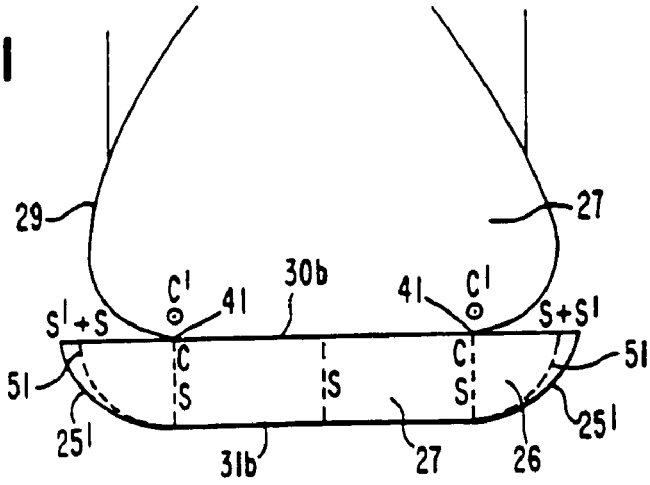
FIG. 11 shows a variation in the thickness of the sole for the quadrant embodiment which is greater than a theoretically ideal stability plane.
Figure 12:
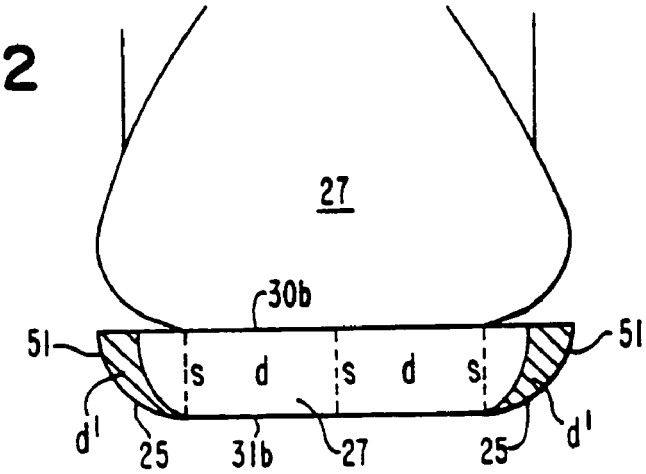
FIG. 12 shows a quadrant embodiment as in FIG. 11 wherein the density of the sole varies.
Figure 13:
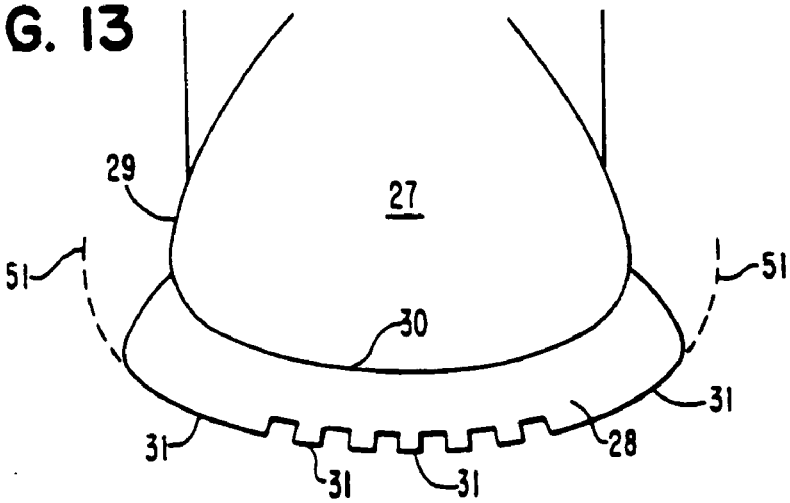
FIG. 13 shows a bottom sole tread design that provides a similar density variation as that in FIG. 10.

FIG. 13 shows a bottom sole tread design that provides about the same overall shoe sole density variation as that provided in FIG. 10 by midsole density variation. The less supporting tread there is under any particular portion of the shoe sole, the less effective overall shoe sole density there is, since the midsole above that portion will deform more easily that if it were fully supported.

FIG. 14 shows embodiments like those in FIGS. 4 through 13 but wherein a portion of the shoe sole thickness is decreased to less than the theoretically ideal stability plane. It is anticipated that some individuals with foot and ankle biomechanics that have been degraded by existing shoes may benefit from such embodiments, which would provide less than natural stability but greater freedom of motion, and less shoe sole weight add bulk. In particular, it is anticipated that individuals with overly rigid feet, those with restricted range of motion, and those tending to over-supinate may benefit from the FIG. 14 embodiments. Even more particularly it is expected that the invention will benefit individuals with significant bilateral foot function asymmetry: namely, a tendency toward pronation on one foot and supination on the other foot. Consequently, it is anticipated that this embodiment would be used only on the shoe sole of the supinating foot, and on the inside portion only, possibly only a portion thereof. It is expected that the range less than the theoretically ideal stability plane would be a maximum of about five to ten percent, though a maximum of up to twenty-five percent may be beneficial to some individuals.

Figure 14A:
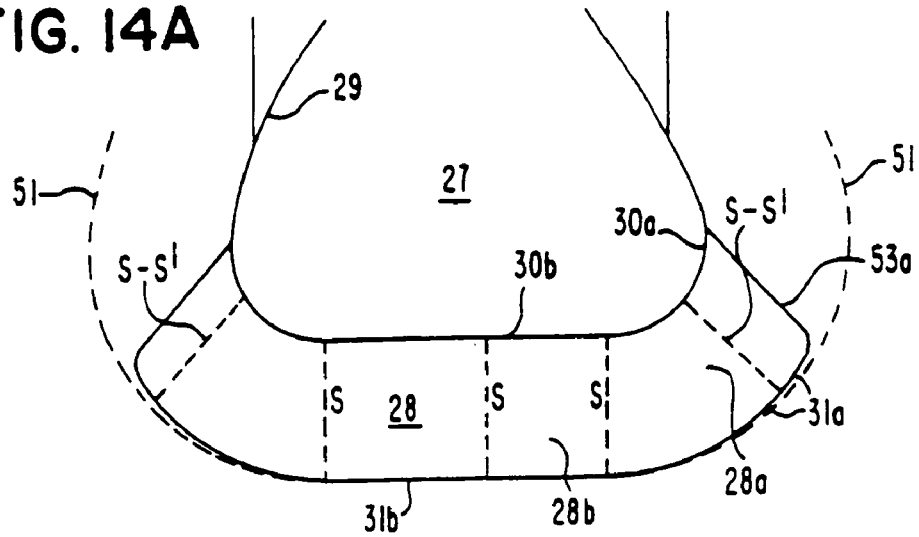
FIGS. 14A-14C shows embodiments like FIGS. 1 through 3 but wherein a portion of the shoe sole thickness is decreased to less than the theoretically ideal stability plan.
Figure 14B:
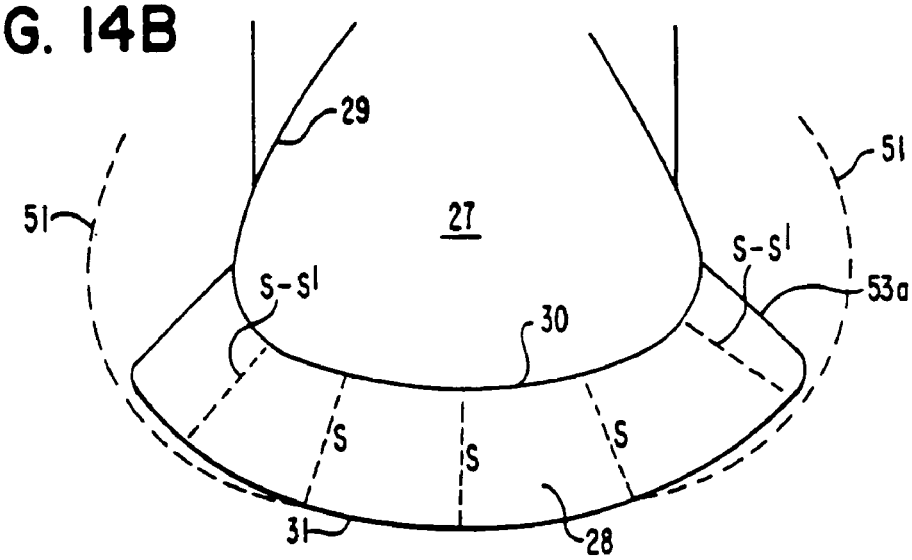
Figure 14C:
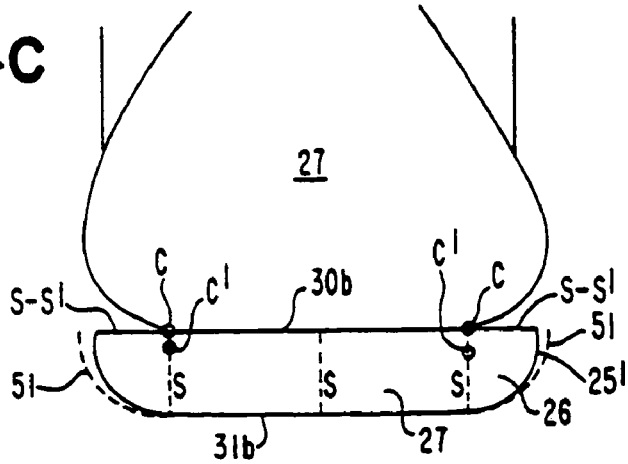

FIG. 14A shows an embodiment like FIGS. 4 and 7, but with naturally contoured sides less than the theoretically ideal stability plane. FIG. 14B shows an embodiment like the fully contoured design in FIGS. 5 and 6, but with a shoe sole thickness decreasing with increasing distance from the center portion of the sole. FIG. 14C shows an embodiment like the quadrant-sided design of FIG. 11, but with the quadrant sides increasingly reduced from is the theoretically ideal stability plane.

The lesser-sided design of FIG. 14 would also apply to the FIGS. 8 through 10 and 12 density variation approach and to the FIG. 13 approach using tread design to approximate density variation.

Figure 15A:
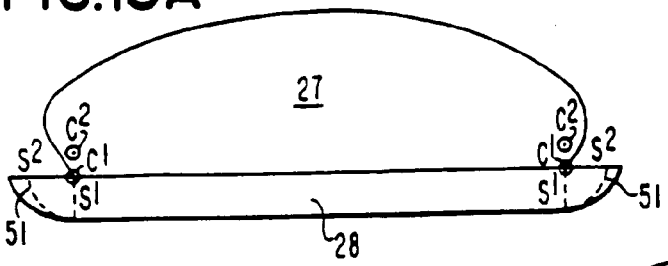
FIGS. 15A-F show embodiments with sides both greater and lesser than the theoretically ideal stability plane.
Figure 15D:
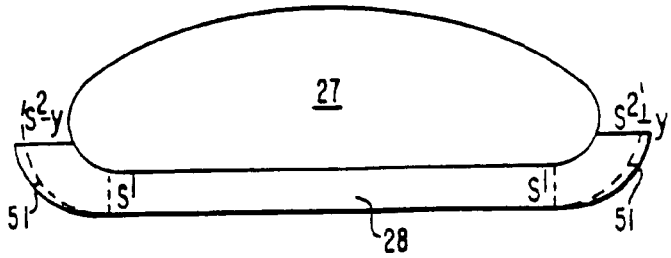
Figure 15B:
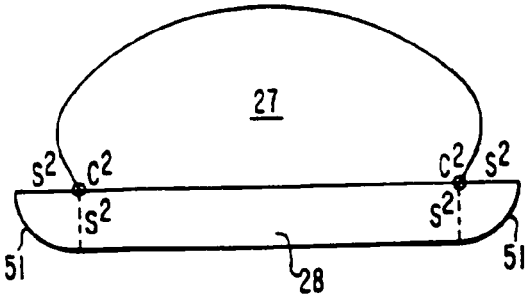
Figure 15E:
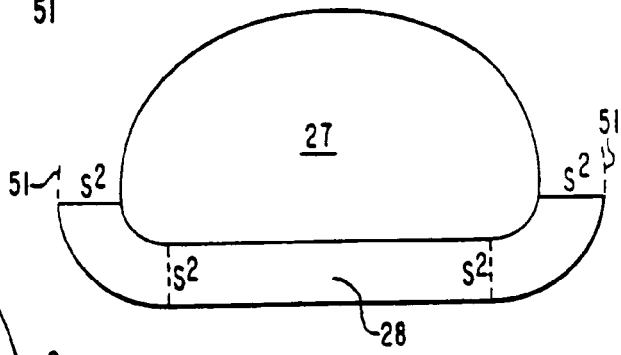
Figure 15C:
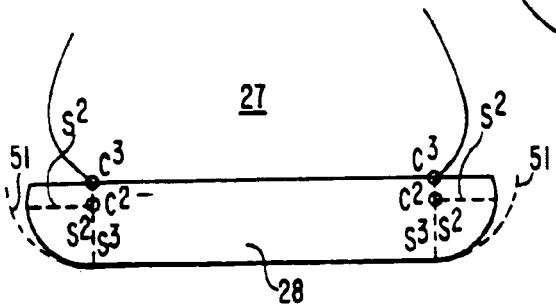

FIGS. 15A-C show, in cross sections similar to those in pending U.S. application Ser. No. 07/219,387, that with the quadrant-sided design of FIGS. 3, 11, 12 and 14C that it is possible to have shoe sole sides that are both greater and lesser than the theoretically ideal stability plane in the same shoe. The radius of an intermediate shoe sole thickness, taken at ($S^2$) at the base of the fifth metatarsal in FIG. 15B, is maintained constant throughout the quadrant sides of the shoe sole, including both the heel, FIG. 15C, and the forefoot, FIG. 15A, so that the side thickness is less than the theoretically ideal stability plane at the heel and more at the forefoot. Though possible, this is not a preferred approach.

Figure 15F:
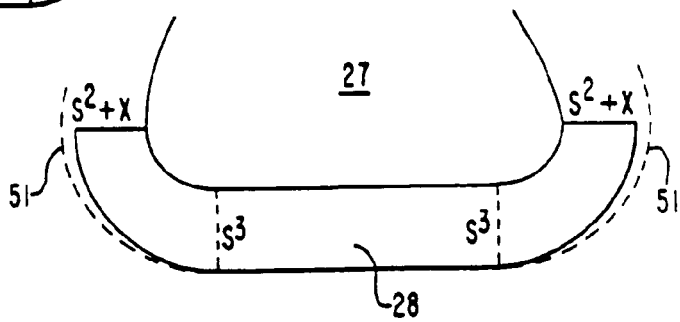

The same approach can be applied to the naturally contoured sides or fully contoured designs described in FIGS. 1, 2, 4 through 10 and 13, but it is also not preferred. In addition, is shown in FIGS. 15D-F, in cross sections similar to those in pending U.S. application Ser. No. 07/239,667, it is possible to have shoe sole sides that are both greater and lesser than the theoretically ideal stability plane in the same shoe, like FIGS. 15A-C, but wherein the side thickness (or radius) is neither constant like FIGS. 15A-C or varying directly with shoe sole thickness, like in the applicant's pending applications, but instead varying quite indirectly with shoe sole thickness. As shown in FIGS. 15D-F, the shoe sole side thickness varies from somewhat less than shoe sole thickness at the heel to somewhat more at the forefoot. This approach, though possible, is again not preferred, and can be applied to the quadrant sided design, but is not preferred there either.

The foregoing shoe designs meet the objectives of this invention as stated above. However, it will clearly be understood by those skilled in the art that the foregoing description has been made in terms of the preferred embodiments and various changes and modifications may be made without departing from the scope of the present invention which is to be defined by the appended claims.

What is claimed is:

1. A sole suitable for an athletic shoe comprising:

a sole outer surface;

a sole inner surface;

the sole surfaces of the sole for the athletic shoe defining a sole medial side, a sole lateral side and a sole middle portion located between said sole sides;

a sole forefoot area at a location substantially corresponding to the location of a forefoot of an intended wearer's foot when inside the shoe;

a sole heel area at a location substantially corresponding to the location of a heel of an intended wearer's foot when inside the shoe;

a sole midtarsal area at a location substantially corresponding to the area between the heel and the forefoot of the intended wearer's foot when inside the shoe;

a midsole component defined by an inner midsole surface and an outer midsole surface, said midsole component extending to the sole middle portion and at least one sole side portion, as viewed in a frontal plane cross-section when the shoe sole is upright and in an unloaded condition, said midsole component having three different firmnesses or densities;

the outer midsole surface of one of the lateral and medial sides comprising a concavely rounded portion located in at least one shoe sole side, and extending at least below a level of a lowest point of the midsole inner surface, as viewed in a shoe sole frontal plane cross-section when the shoe sole is upright and in an unloaded condition, the concavity of the concavely rounded portion of the outer midsole surface existing with respect to an inner section of the midsole component directly adjacent to the concavely rounded portion of the outer midsole surface, the inner midsole surface of the side of the shoe sole which has a concavely rounded portion of the outer midsole surface comprising a convexly rounded portion, as viewed in the shoe sole frontal plane cross-section when the shoe sole is upright and in an unloaded condition, the convexity of the convexly rounded portion of the inner midsole surface existing with respect to a section of the midsole component directly adjacent to the convexly rounded portion of the inner midsole surface;

a portion of a sole side located between the sole inner surface and the sole outer surface having a thickness between the sole inner surface and the sole outer surface that is greater than a least thickness of the shoe sole in the sole middle portion between the sole inner surface and the sole outer surface, said thickness being defined as the distance between a first point on the sole inner surface and a second point on the sole outer surface, said second point being located along a straight line perpendicular to a straight line tangent to the sole inner surface at said first point, all as viewed in the frontal plane cross-section when the shoe sole is upright and in an unloaded condition;

the sole having a lateral sidemost section defined by that portion of said sole located outside of a straight vertical line extending through the shoe sole at a lateral sidemost extent of the inner surface of the midsole component, as viewed in a shoe sole frontal plane cross-section when the shoe sole is upright and in an unloaded condition;

the sole having a medial sidemost section defined by that portion of said sole located outside of a straight vertical line extending through the shoe sole at a medial sidemost extent of the inner surface of the midsole component, as viewed in the shoe sole frontal plane cross-section when the shoe sole is upright and in an unloaded condition;

at least a part of the midsole component extends into the sidemost section of at least one shoe sole side, as viewed in the shoe sole frontal plane cross-section when the shoe sole is upright and in an unloaded condition; and the part of the midsole component that extends into the sidemost section of the at least one shoe sole side further extends to above a lowermost point of the inner midsole surface of the midsole component on the same sole side, as viewed in the shoe sole frontal plane cross-section when the shoe sole is upright and in an unloaded condition.

2. The sole as set forth in claim 1, wherein the midsole component comprises portions with first, second and third firmnesses or densities, the portion having the first firmness or density being located adjacent a side edge of the shoe sole and the portion having the second firmness or density being located adjacent to a center line of the shoe sole, all as viewed in the frontal plane cross-section when the shoe sole is upright and in an unloaded condition, and the first firmness or density is greater than the second firmness or density when the shoe sole is in an unloaded condition.

3. The sole as set forth in claim 1, wherein the midsole component comprises portions of first, second and third firmnesses or densities, said portion of first firmness or density having a lesser firmness or density than said portion of second firmness or density, said portion of first firmness or density being located in a heel area of the shoe sole, and said portion of second firmness or density being located adjacent said portion of first firmness or density.

4. The sole as set forth in claim 1, wherein both the sole lateral side and the sole medial side comprise a convexly rounded portion of the inner midsole surface portion and a concavely rounded portion of the outer midsole surface, as viewed in the shoe sole frontal plane cross-section when the shoe sole is upright and in an unloaded condition.

5. The shoe sole as set forth in claim 1, wherein said concavely rounded portion of the outer midsole surface extends down to near a lowest point of the outer midsole surface of the midsole component which is located in one of the shoe sole sides, as viewed in the shoe sole frontal plane cross-section when the shoe sole is upright and in an unloaded condition.

6. The sole as set forth in claim 1, wherein the midsole component comprises portions with first, second and third firmnesses or densities, and one of said portions of first and second firmness or density in the midsole component has a greater thickness in the sole side portion than a thickness of the same midsole component in the sole middle portion, as viewed in the shoe sole frontal plane cross-section when the shoe sole is upright and in an unloaded condition.

7. The shoe sole set forth in claim 1, wherein the concavely rounded portion of the outer midsole surface extends through a sidemost extent of the outer midsole surface located in the same sole side, as viewed in the shoe sole frontal plane cross-section when the shoe sole is upright and in an unloaded condition.

8. The sole as set forth in claim 1, wherein a first firmness or density portion of the midsole component having a first firmness or density forms at least part of the outer midsole surface of the midsole component, and a second firmness or density portion of the midsole component having a second firmness or density forms at least part of the inner midsole surface of the midsole component, all as viewed in the frontal plane cross-section when the shoe sole is upright and in an unloaded condition.

9. The shoe sole as set forth in claim 8, wherein the first firmness or density portion of the midsole component forms at least part of the outer midsole surface of the midsole part that extends into the sidemost section of the shoe sole side, as viewed in a frontal plane cross-section when the shoe sole is upright and in an unloaded condition.

10. The shoe sole as set forth in claim 9, wherein the first firmness or density portion of the midsole component forms substantially the entire concavely rounded portion of the outer midsole surface of the midsole part that extends into the sidemost section of the shoe sole side, as viewed in the frontal plane cross-section when the shoe sole is upright and in an unloaded condition.

11. The shoe sole as set forth in claim 8, wherein a second firmness or density portion of the midsole component forms substantially the entire inner midsole surface of the midsole component, as viewed in a frontal plane cross-section when the shoe sole is upright and in an unloaded condition.

12. The sole as set forth in claim 8, wherein the first firmness or density portion of the midsole component has a greater firmness or density than a second firmness or density portion of said midsole component.

13. The shoe sole as set forth in claim 1, wherein said concavely rounded portion of the outer midsole surface extends down to near a lowest point of the outer midsole surface in one of the lateral and medial sidemost sections of the shoe sole sides, as viewed in the shoe sole frontal plane cross-section when the shoe sole is upright and in an unloaded condition.

14. The shoe sole as set forth in claim 9, wherein the second firmness or density portion of the midsole component encompasses at least part of a centerline of the midsole component, as viewed in a frontal plane cross-section when the shoe sole is upright and in an unloaded condition.

15. The shoe sole as set forth in claim 8, wherein at least a part of a boundary between the first and second firmness or density portions of the midsole component is concavely rounded relative to a section of the second firmness or density portion of the midsole component adjacent to the boundary, as viewed in a frontal plane cross-section when the shoe sole is upright and in an unloaded condition.

16. The shoe sole as set forth in claim 8, wherein at least a part of a boundary between the first and second firmness or density portions of the midsole component is concavely rounded relative to a section of the first firmness or density portion of the midsole component adjacent to the boundary, as viewed in a frontal plane cross-section when the shoe sole is upright and in an unloaded condition.

17. A shoe sole as claimed in claim 1, wherein a thickness between an inner midsole surface of the midsole part which extends into the sidemost section of the shoe sole side, and an outer midsole surface of the midsole part which extends into the sidemost section of the shoe sole side increases gradually from a thickness at an uppermost point of each of said upper portions of the midsole part to a greater thickness at a location below the uppermost point of each said upper portion of the midsole part, said thickness being defined as the distance between a first point on the inner midsole surface of the midsole component and a second point on the outer midsole surface of the midsole component, said second point being located along a straight line perpendicular to a straight line tangent to the inner midsole surface of the midsole component at said first point, all as viewed in a frontal plane cross-section when the shoe sole is upright and in an unloaded condition.

18. The shoe sole as set forth in claim 8, wherein the frontal plane cross-section is located in a heel area of the shoe sole.

19. The shoe sole as set forth in claim 8, wherein the frontal plane cross-section is located in a forefoot area of the shoe sole.

20. The shoe sole as set forth in claim 1, wherein the concavely rounded portion of the outer midsole surface extends down to near a lowermost point of the midsole component, as viewed in a frontal plane cross-section when the shoe sole is upright and in an unloaded condition.

21. The shoe sole as set forth in claim 1, wherein the concavely rounded portion of the outer midsole surface extends up to a level above the lowest point of the inner midsole surface of the midsole component, as viewed in a shoe sole frontal plane cross-section when the shoe sole is upright and in an unloaded condition.

22. The shoe sole as set forth in claim 1, wherein the concavely rounded portion of the outer midsole surface extends from an uppermost portion of the shoe sole side to a level below the lowest point of the inner midsole surface, as viewed in a shoe sole frontal plane cross-section when the shoe sole is upright and in an unloaded condition.

23. The shoe sole as set forth in claim 1, wherein the portions of the midsole component having three different firmnesses or densities can be viewed in a single frontal plane cross-section when the shoe sole is upright and in an unloaded condition.

24. The shoe sole as set forth in claim 23, wherein the thickness of the portion of the midsole part which extends into the sidemost section of the at least one shoe sole side increases from a first thickness at an uppermost point on the midsole part to a greater thickness at a portion of said midsole part below said uppermost point, as viewed in a shoe sole frontal plane cross-section when the shoe sole is upright and in an unloaded condition; and the thickness of the midsole part being defined as the length of a line starting at a starting point on the inner midsole surface of the midsole component and extending to an outer midsole surface of the midsole component in a direction perpendicular to a line tangent to the inner midsole surface of the midsole component at the starting point, as viewed in a show sole frontal plane cross-section when the shoe sole is upright and in an unloaded condition.

25. The shoe sole as set forth in claim 1, wherein a midsole portion of greatest firmness or density is located adjacent a side edge of the shoe sole, a midsole portion of least firmness or density is located adjacent a centerline of the shoe sole, and a midsole portion of intermediate firmness or density is located between the midsole portion of greatest firmness or density and the midsole portion of least firmness or density, as viewed in a, frontal plane cross-section when the shoe sole is upright and in an unloaded condition.

26. The shoe sole as set forth in claim 25, further comprising a second midsole portion of greatest firmness or density adjacent a second side edge of the shoe sole and a second midsole portion of intermediate firmness or density located between the second midsole portion of greatest firmness or density and the midsole portion of least firmness or density, as viewed ma frontal plane cross-section when the shoe sole is upright and in an unloaded condition.

27. The shoe sole as set forth in claim 1, wherein a midsole portion of least firmness or density is located adjacent a centerline of the shoe sole, a midsole portion of greatest firmness or density is located on a first side of the midsole portion of least firmness or density, and a midsole portion of intermediate firmness or density is located on a second side of the midsole portion of least firmness or density, as viewed in a frontal plane cross-section when the shoe sole is upright and in an unloaded condition.

28. A shoe sole as claimed in claim 27, wherein the midsole portions of intermediate and greatest firmness or density are also located adjacent to first and second side edges of the shoe sole, as viewed in a frontal plane cross-section when the shoe sole is upright and in an unloaded condition.

29. The shoe sole as set forth in claim 1, wherein the shoe is an athletic shoe.

* * * * *